US009061428B2

(12) United States Patent
Brada et al.

(10) Patent No.: US 9,061,428 B2
(45) Date of Patent: Jun. 23, 2015

(54) SHAVING APPARATUS

(71) Applicant: KONINKLIJKE PHILIPS N.V., Eindhoven (NL)

(72) Inventors: Ype Brada, Leeuwarden (NL); Robert A. van Eibergen Santhagens, DeWilgen (NL); Wilko Westerhof, Drachten (NL)

(73) Assignee: KONINKLIJKE PHILIPS N.V., Eindhoven (NL)

( * ) Notice: Subject to any disclaimer, the term of this patent is extended or adjusted under 35 U.S.C. 154(b) by 0 days.

(21) Appl. No.: 14/061,813

(22) Filed: Oct. 24, 2013

(65) Prior Publication Data

US 2014/0047717 A1 Feb. 20, 2014

Related U.S. Application Data

(63) Continuation of application No. 13/071,605, filed on Mar. 25, 2011, now Pat. No. 8,595,939, which is a continuation of application No. 11/722,642, filed as application No. PCT/IB2005/054296 on Dec. 19, 2005, now Pat. No. 7,930,828.

(30) Foreign Application Priority Data

Dec. 22, 2004 (EP) ..... 04106856

(51) Int. Cl.
*B26B 19/14* (2006.01)
*B26B 19/38* (2006.01)

(52) U.S. Cl.
CPC ..... *B26B 19/145* (2013.01); *B26B 19/141* (2013.01); *B26B 19/14* (2013.01); *B26B 19/146* (2013.01); *B26B 19/38* (2013.01)

(58) Field of Classification Search
USPC ..... 30/43.5, 43.6, 42, 45, 43.4, 527
See application file for complete search history.

(56) References Cited

U.S. PATENT DOCUMENTS

| | | | |
|---|---|---|---|
| 2,499,249 | A | 2/1950 | Jay |
| 2,839,225 | A | 6/1958 | Soffer et al. |
| 3,858,316 | A | 1/1975 | Tietjens |
| 3,913,225 | A | 10/1975 | Tietjens et al. |
| 4,077,120 | A | 3/1978 | Herrick et al. |
| 4,168,570 | A | 9/1979 | Bakker et al. |
| 4,688,329 | A | 8/1987 | Oord |
| 5,007,168 | A | 4/1991 | Messinger |
| 5,625,950 | A | 5/1997 | Sterk et al. |
| 6,671,960 | B2 | 1/2004 | Kawafune et al. |

(Continued)

FOREIGN PATENT DOCUMENTS

| | | |
|---|---|---|
| DE | 9014307 | 2/1991 |
| DE | 20304170 U1 | 7/2004 |

(Continued)

*Primary Examiner* — Omar Flores Sanchez

(57) ABSTRACT

A shaving apparatus has at least one cutting unit (3) having an outer shaving surface (7) for contacting the skin, interrupted by hair entry apertures (8), an internal cutter (5) which is drivable for movement along the hair entry apertures (8) for cutting off hairs projecting through the hair entry apertures (8). A suspension member (6) via which the external cutter is suspended relative to the holder (2) is tiltable relative to the holder (2) about a tilting axis (17) located more closely to a first peripheral portion (18) of the shaving surface (7) than to a second peripheral portion (19) of the shaving surface (7) opposite to said first peripheral portion (18) of said shaving surface (7).

20 Claims, 6 Drawing Sheets

(56) References Cited

U.S. PATENT DOCUMENTS

| | | | |
|---|---|---|---|
| 6,823,590 | B2 | 11/2004 | Uchiyama et al. |
| 7,152,324 | B2 | 12/2006 | Uchiyama |
| 7,584,541 | B2 | 9/2009 | Uchiyama |

FOREIGN PATENT DOCUMENTS

| | | | |
|---|---|---|---|
| EP | 0838813 | A2 | 4/1998 |
| GB | 2266070 | | 10/1993 |
| JP | 6171088 | A | 4/1986 |
| JP | 11509766 | A | 8/1998 |
| WO | 9835794 | A | 8/1998 |

SHAVING APPARATUS

This application claims the benefit or priority of and describes relationships between the following applications: wherein this application is a continuation of U.S. patent application Ser. No. 13/071605, filed Mar. 25, 2011, which is a continuation of Ser. No. 11/722,462, filed Jun. 21, 2007, now U.S. Pat. No. 7,930,828 issued Apr. 26, 2011 which is the National Stage of International Application No. PCT/IB2005/054296, filed Dec. 19, 2005, which claims the priority of foreign application EP04106856.0 filed Dec. 22, 2004, all of which are incorporated herein in whole by reference.

The invention relates to a shaving apparatus having a housing, provided with a holder to which at least two cutting units are mounted, which cutting units each comprise an external cutter having an outer shaving surface for contacting the skin, interrupted by hair entry apertures, an internal cutter which is drivable for movement along the hair entry apertures for cutting off hairs projecting through the hair entry apertures, and a suspension member via which the external cutter is suspended relative to the holder, wherein the suspension member of each cutting unit is individually tiltable relative to the holder about a tilting axis.

Such a shaving apparatus is known from U.S. Pat. No. 5,625,950. In this known apparatus the suspension member also forms a skin support rim, which serves for slightly tautening the skin before the external cutter is moved over the skin. Thus, it is achieved that the hairs to be severed are better erected so that they can be severed better and closer to the skin. An even more important function of the skin support rim is to support the skin around the external cutter. This ensures that the pressure on the external cutter does not become too high. An excessive pressure leads to skin injury and irritation because the skin then penetrates further into the hair-entry apertures and can come into contact with the internal cutter. The external cutter is mounted in the holder so as to allow movement in, preferably, any direction. As a result, the shaving surface, which is formed by the outer surface of the external cutter facing the skin, can adapt itself to the shape of the facial area to be shaved. The maximum permissible tilting angle of the external cutter, is determined by the length over which the external cutter projects above the skin support rim. A large projection length gives rise to large pressure peaks on the peripheral parts of the external cutter because the skin support rim cannot properly support the skin, whereas a small projection limits the angle over which the shaving surface is tiltable relative to the holder.

In this shaving apparatus, the angle over which the shaving surface can be tilted is increased by providing that the skin support rim—which forms a suspension member in the sense that it determines the position and the orientation of the external cutter that is resiliently biased against the support rim by spring force—is tiltable relative to the holder.

Although conformability to the shape of the skin to be shaved and to variation in angulation of the shaving apparatus relative to the skin to be shaved is thus improved, and pressure peaks on the external cutter are thus precluded, skin irritation still occurs if the user presses the shaving apparatus against the skin to be shaved with too much force.

It is an object of the invention to provide a solution to further counteract skin irritation caused by the user pressing the shaving apparatus against the skin with too much force.

In order to achieve this object, a shaving apparatus according to the invention is characterized in that the tilting axis of each suspension member is located more closely to a first peripheral portion of the shaving surface of the associated cutting unit than to a second peripheral portion of the shaving surface of the associated cutting unit opposite to said first peripheral portion of said shaving surface.

According to the present invention, this object is achieved by providing a shaving apparatus according to claim 1.

Since the tilting axis about which the suspension member is tiltable together with the shaving surface is located more closely to a first peripheral portion of the shaving surface than to a second peripheral portion of the shaving surface opposite to the first peripheral portion of the shaving surface, pressing the shaving apparatus is to the skin too hard, causes the shaving surface to be pressed against the skin with relatively high pressure predominantly in the area of the first peripheral portion of the shaving surface and too a lesser extent, if at all, in the area of the second peripheral portion of the shaving surface. Thus, the second portion of the shaving surface is less affected by the excessive pressure applied by the user and will therefore cause less skin irritation.

Particular further elaborations of the present invention are set forth in the dependent claims.

Further aspects, effects and details of the invention are described in with reference to an exemplary embodiment shown in the drawings.

Figure 1:
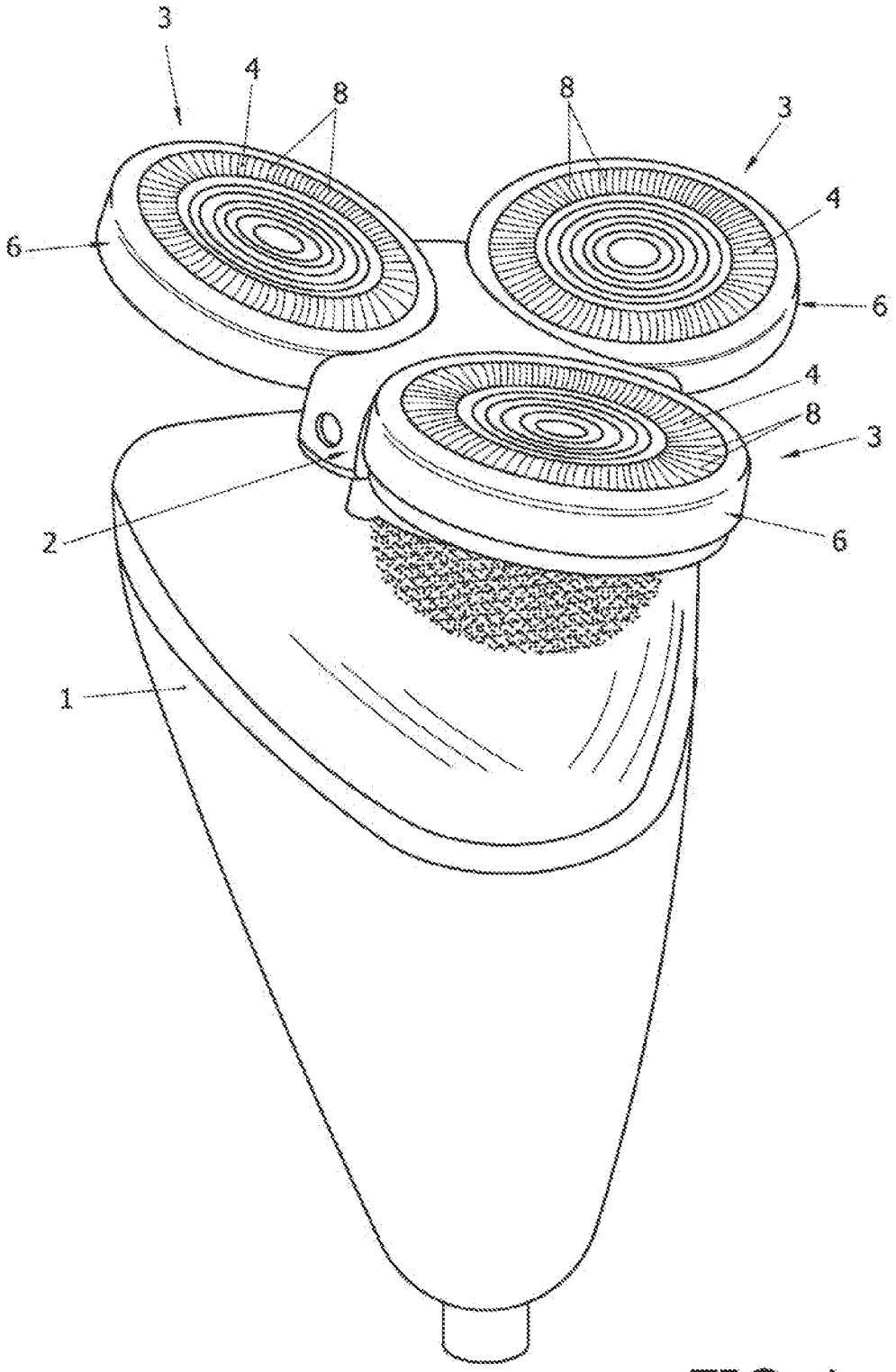
FIG. 1 is a perspective view of an example of a shaving apparatus according to the invention.
Figure 2:
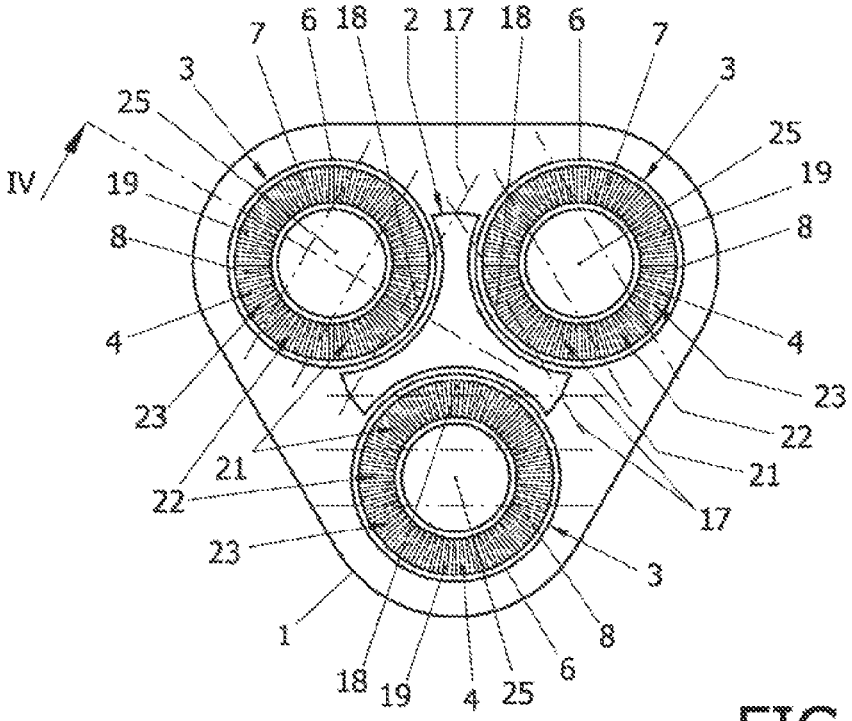
FIG. 2 is a plan view of the cutting units and a portion of the housing of the shaving apparatus according to FIG. 1.

The rotary shaving apparatus shown in FIG. 1 has a housing 1 with a detachable holder 2. To the holder, three cutting units 3 are mounted, which units each include an external cutter 4 and an internal cutter 5 (see FIGS. 4-6). The external cutter 4 is suspended by a suspension member 6, which is generally circular. The external cutter 4 is formed by a shield that has a substantially flat shaving surface 7 for contacting the skin during shaving and a multitude of slit-shaped hair entry apertures 8 of which internal edges form cutting edges. The internal cutter 5 is rotatably mounted in the external cutter 4 and has a plurality of cutting blades 9 (see FIG. 4) secured to a support portion 10. The cutting blades 9 have cutting edges that are arranged for co-operation with the cutting edges of the external cutter 4. The support portion 10 is directly attached at its bottom side to a cutting unit gear wheel 11, which is rotatable by a drive gear wheel 12 that engages the cutting unit gear wheel 11.

The suspension member 6 includes a skin support rim 13 formed on an upper suspension member part 15 and a lower suspension member part 14 on the same side of the external cutter 4 as the internal cutter 5. The upper suspension member part 15 is snap locked to the lower suspension member part 14 and flanges of the external cutter 4 are enclosed between the suspension member parts 14, 15. Between the lower suspension member part 14 and the cutting unit gear wheel 11, a spring 16 is located, which biases the cutting unit gear wheel 11 and, via the cutting unit gear wheel 11, the internal cutter 5 towards the external cutter 4 so as to maintain proper contact between the cutters during shaving. According to the present example, the spring 16 is a leaf spring having a central support area engaging the cutting unit gear wheel 11 and three leaf spring legs engaging the suspension member 6. However, other spring designs, such as a coil shaped spring, can in principle also be employed.

The suspension member is 6 hingedly connected to a central holder base 26 (see FIGS. 4 and 5), so as to be tiltable around a tilting axis 17 extending substantially parallel to the shaving surface 7. To this end, the holder base 26 is equipped with support posts 29 that are equipped with notches 30 that engage bores 31 in the suspension members 6.

The tilting axes 17 are each oriented tangentially to the respective cutter gear wheel 11 mounted to the suspension member 6 and to the drive gear wheel 12 engaging the cutter gear wheel 11 for driving the cutter gear wheel 11 and each extend through an area where teeth of the drive gear wheel 12 engage teeth of the respective cutter gear wheel 11. This allows the suspension member 6 and the cutter gear wheel 11 suspended thereto to be tilted about the associated tilting axis 17 without causing the drive gear wheel 12 to be disengaged from the cutter gear wheel 11. Preferably, the tilting axes are each tangential to the pitch circles of the drive gear wheel 12 and the respective cutter gear wheel 11.

Furthermore, a leaf spring plate 27 is mounted to the holder base 26 (see FIGS. 3-5) for biasing the suspension members away from the housing 1, so that the cutting units 3 are biased towards a rest position, as depicted in FIG. 1, in which the shaving surfaces 7 of the cutting units 3 define an overall shaving surface having a generally concave shape. During use, the suspension members 6 and thereby the shaving surfaces 7 of the respective cutting units 3 can be tilted around their respective tilting axes 17 by external force exerted thereon by a user. The leaf spring plate 27 forms a biasing means that exerts a force for keeping the shaving surfaces 7 in contact with a user's skin, thus ensuring good conformability to differences in curvature of the skin surface encountered during shaving.

The central holder base 26 is centrally connected to the shaving apparatus body 2, around a drive shaft (not shown). Furthermore, a cover 37 is provided, which is mounted on top of the holder base 26, and which is provided with a central spindle 28 for rotatably mounting the drive gearwheel 12, in such way that this gear wheel 12 engages the cutting unit gear wheels 11.

Figure 3:
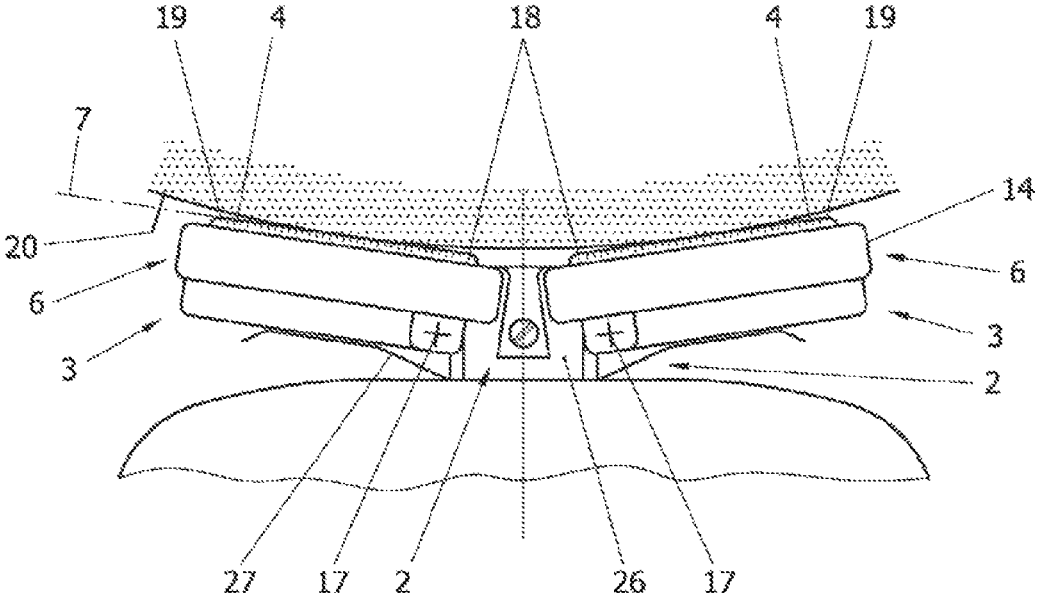
FIG. 3 is a side view of the cutting units, the holder and a portion of the housing of the shaving apparatus according to FIG. 1.

The suspension member 6 of each cutting unit 3 is individually tiltable relative to the holder 2 about a tilting axis 17. The tilting axis 17 is located more closely to a first peripheral portion 18 of the shaving surface 7 than to a second peripheral portion 19 of the shaving surface 7 opposite to the first peripheral portion 18 of the shaving surface 7. Preferably the distance from the tilting axis 17 to the closest peripheral edge of the shaving surface 7 is at most 50% and more preferably at most 10% to 25% of the distance from the tilting axis 17 to the opposite edge of the shaving surface. If the shaving apparatus is pressed against a skin surface 20, for instance as is illustrated in FIG. 3, an increase of the force with which the shaving apparatus 1 is pressed against the skin surface 20 is predominantly transferred by portions of the shaving surface 7 in the area of the first peripheral shaving surface portions 18 closest to the tilting axis 17. The contact pressure between portions of the shaving surface 7 more closely to the second peripheral shaving surface portion 19, i.e. those portions of the shaving surface 7 which are located relatively remote from the tilting axis 17, and the skin surface 20 is to a lesser extent dependent on the force with which the shaving apparatus is pressed against the skin surface 20, since the suspension members 6, and accordingly also the external cutters 4 suspended thereby, tend to tilt away from the skin 20 when the force with which the cutting units 3 are pressed against the skin 20 is increased.

Accordingly, the contact pressure between substantial portions of the shaving surface 7 and the skin surface is influenced at most minimally by pressing the shaving apparatus to the skin too hard, so that skin irritation caused by those portions of the shaving surface 7 is minimized.

The generally resilient nature of the skin surface 20, which tends to be compressed and displaced if a local pressure is exerted thereon moreover causes the shaving surface 7 to tilt if too much pressure is exerted, optionally against forces exerted by means for biasing the second peripheral shaving surface portion 19, i.e. those portions of the shaving surface 7 which are located relatively remote from the tilting axis 17, against the skin.

This tilting effect also causes the peripheral edges of the cutting units 3 to be pressed against the skin, which causes the user to feel more clearly that the force with which the shaving apparatus is held against the skin is too large and stimulates the user to press the shaving apparatus against the skin with less pressure.

According to the present example, the shaving apparatus is equipped with three cutting units 3. However, the invention may also be applied in shaving apparatuses having a single, two or more than three cutting units with a rotary or otherwise movable internal cutter. In multi cutting unit shaving apparatuses, the tilting axis may extend along portions of the shaving surfaces located close to or remote from the other cutting units.

According to the present example, the shaving surfaces 7 of the external cutters 4, each extend over at least two different shaving zones 21, 22, 23. A first one 21 of the shaving zones is located closest to the tilting axis 17. A second one 23 of the shaving zones is located most remote from the tilting axis 17. In the present example, an intermediate one 22 of the zones is located between the aforementioned zones 21 and 23. Furthermore, the first one 21 of the shaving zones 21-23 is adapted for allowing the skin to dome less closely to the cutting edges of the internal cutter 5, at a given local contact pressure between the shaving surface and the skin, than the other ones of the shaving zones 22, 23. This further reduces skin irritation, which could be caused by increased contact pressure between the first one 21 of the shaving zones and the skin surface 20 if the shaving apparatus is pressed against the skin too hard. Conversely, that the shaving surface zones 22 and 23, which are located more remote from the tilting axis 17, are designed for allowing the skin to dome to relatively close to the cutting edges of the internal cutter 5, at a given local contact pressure between the shaving surface and the skin, ensure a very close shaving result. Skin irritation is reduced compared to the extent that it would normally occur when allowing the skin to dome that far to the internal cutter at the given contact pressure, because pressing the shaver to the skin with too much force, as occurs often in practice, only causes relatively little, if any, increase in contact pressure between the skin surface 20 and the shaving surface zones 22 and in particular 23 that are located more remote from the tilting axis 17. Thus, the improved control over the contact pressure in the areas of the shaving surface more remote from the tilting axis allows to design the external cutter more critically in those areas without entailing an increased occurrence of skin irritation as would normally be associated to such a critical design of the external cutter.

The differences in skin doming between the shaving zones can be achieved in various manners. According to the present example, these differences are obtained by providing that, along the shaving surfaces 7, each one of the external cutters 4 is thicker in the first zone 21 than in the zone 23 most remote from the tilting axis 17. The thickness of the external cutters 4 may also decrease gradually or stepwise from the first zone 21 closest to the tilting axis 17 to the zone 23 of the shaving surface 7 most remote from the tilting axis 17. Other possibilities for varying the closeness to the internal cutter to which the skin is allowed to dome at a given contact pressure is to vary the width of the slits, skin doming increasing as the slits are wider.

A particularly interesting option is to provide relatively wide slits in the shaving zones close to the tilting axis for improved hair catching and to overcompensate the increased skin doming allowed by wider slits, by an increased thickness of the external cutter in the zones close to the tilting axis. Thus, the shaving zones close to the tilting axis are dedicated for quick, but not very close shaving of long hairs and the shaving zones remote from the tilting axis are dedicated for the final cuts to a very close shave.

Figure 4:
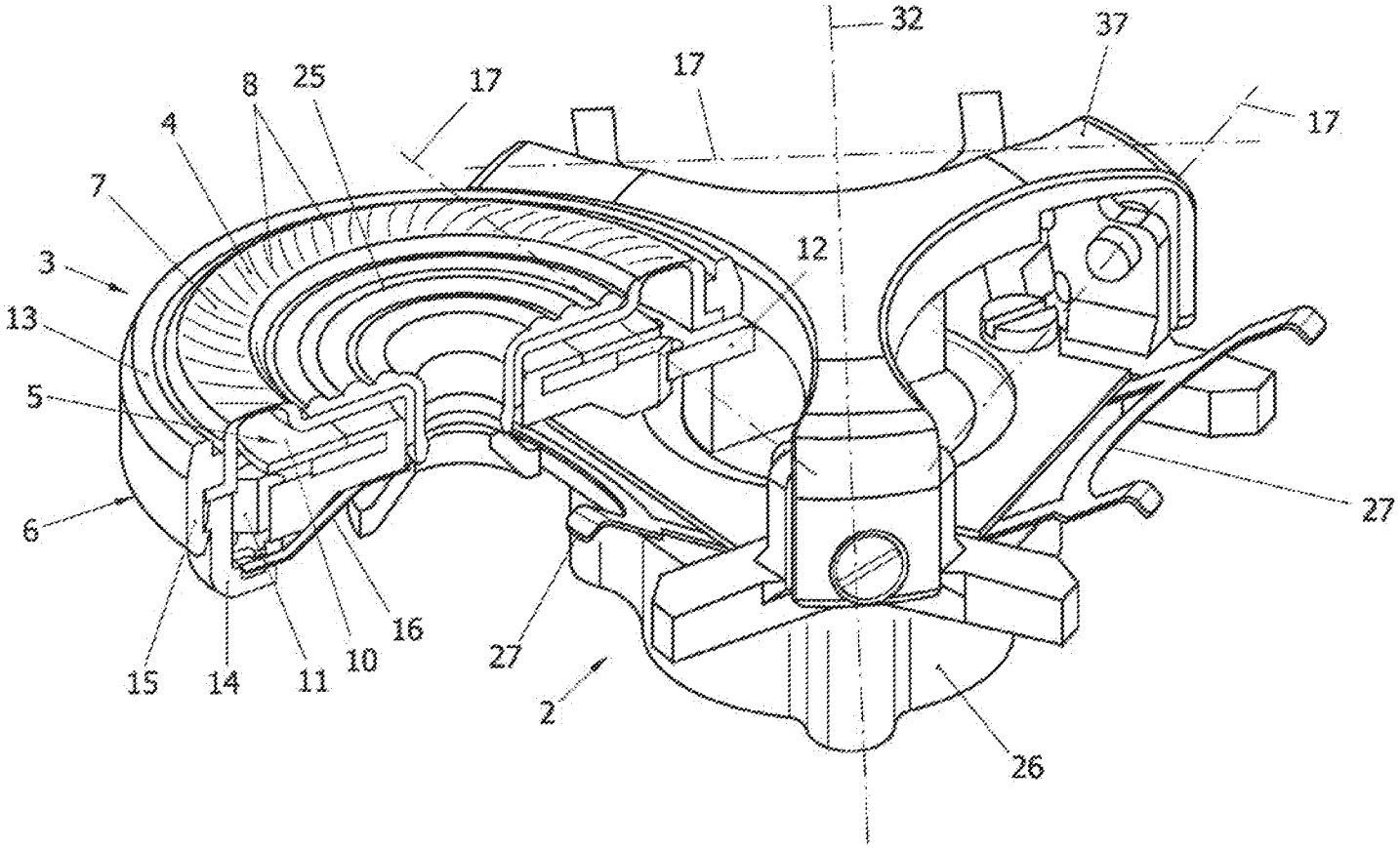
FIG. 4 is a perspective, cut-away view of a holder and a cutting unit of the shaving apparatus according to FIGS. 1-3.
Figure 6:
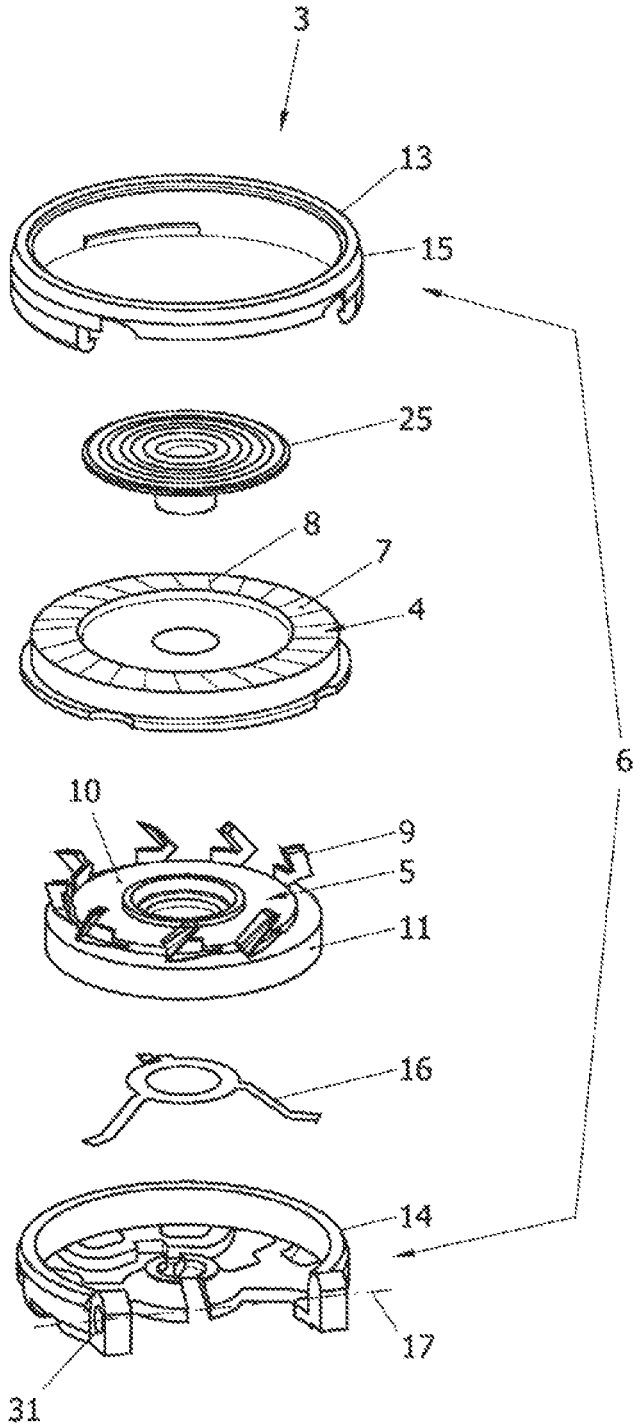
FIG. 6 is a perspective, exploded view of a cutting unit of the shaving apparatus according to FIGS. 1-5.

As is best seen in FIGS. 4 and 6, the skin support rim 13 has a free end projecting closely adjacent a rim of the external cutter 4. The portions of the skin support rim 13 extending along the first portion 21 of the shaving surface 7 project further than the portions of the skin support rim 13 extending along the second portions 23 of the shaving surface 7. Thus, the pressure with which the shaving surface 7 is pressed against the skin surface to be shaved 20 is more limited by the skin support rim 13 in the areas 21 of the shaving surfaces 7 close to the tilting axis 17 where the cutting units 3 may be pressed against the skin with relatively great pressure than in the area 23 of the shaving surface 7 where the contact pressure between the shaving surface 7 and the skin surface 20 is affected very little if at all by the force with which the user pushes the shaving apparatus against the skin surface 20.

A reduction of the effective shaving pressure in the areas close to the tilting axes 17 during shaving while pressing the shaving apparatus to the skin 20 with too much force is also obtained by support of the shaving apparatus against the skin 20 that is provided by the cap 37 between the cutting units 3, which forms a support surface contacting the skin during shaving and which extends exclusively in areas located between at least two of the cutting units 3. Thus, some of the pressure exerted to the shaving apparatus is transferred to the skin via a central area between the cutting units 3 and accordingly does not contribute to the effective shaving pressure occurring the portions of the shaving surfaces 7 close to the tilting axes 17, which portion do not tilt away substantially in response to exertion of too much force.

The cap 37 is adjustable for adjusting the position of a plane along which the support surface extends relative to the position of the planes along which the shaving surfaces 7 extend. This allows to adjust the position of the support surface in a direction perpendicular to that surface in accordance with personal skin sensitivity and shaving habits. According to the present example, the adjustability is provided by three adjustment screws along the periphery of the cap 37, which cause the cap 37 to be bent into a more curved shape when the screws are tightened and vice versa. However, many other solutions for providing such an adjustability are conceivable as well.

For varying the extent to which the contact pressure between the skin and the shaving surface is limited in accordance with the distance to the tilting axis, also the lateral distance between the skin support rim 13 and the shaving surface 7 may be varied in accordance with the distance to the tilting axis 17, such that this distance is smaller along the areas of the shaving surface close to the tilting axis than along the areas of the shaving surface more remote from the tilting axis.

For effectively reducing the surface area of the shaving surface 7 that may be pressed against the skin with an increased pressure by pressing the shaving apparatus against the skin, the tilting axis 17 preferably extends closely along an extreme end of the shaving surface 7. For instance, where rotation of the internal cutter 5 is driveable about an axis transverse to the shaving surface 7, the tilting axis 17 is preferably located closely adjacent an outer border of a perforated shaving area of the shaving surface 7, in which the hair catching apertures 8 are located, as is illustrated by the present example.

Where, as in the present example, the internal cutter 5 has a cutting blade or cutting blades 9 movable along a circular path extending over an inner surface of the external cutter 4, a projection, in a direction perpendicular to the shaving surface 7, of the tilting axis 17 onto the shaving surface 7 extends approximately tangentially to the circular track, and preferably to the middle of the circular track, as is also shown in the present example.

For effectively controlling the pressure with which portions of the shaving surface 7 remote from the tilting axle 17 are pressed against the skin, the suspension of the cutting unit 3 is spring loaded by the spring 27 forming a biasing member biasing the suspension member 6 to a rest configuration tilted away from the housing 1 (and thus against the skin to be shaved when the shaving apparatus is in use). The suspension member 6 is tiltable towards housing 1 by contact pressure between the skin and the shaving surface 7, against the force biasing the suspension member 6 away from the housing. This ensures that, when the shaving surface is held against the skin to be shaved, the contact pressure in the zones of the shaving surface nearest to and in the second peripheral portion 19, i.e. the zones of the shaving surface that are relatively far from the tilting axle 17, are pressed against the skin surface with a contact pressure in a reasonably narrow range. The stiffness of the spring 27 or other biasing member should be selected to achieve that the effective contact pressure during shaving remains within a desired range. The stiffness of the spring (or other biasing member) may optionally be adjustable to adjust the stiffness to a user's skin sensitivity. The contact pressure may vary somewhat as a function of the angle between the housing 1 and the skin surface 20 to be shaved.

According to the present example, the shaving apparatus is equipped with a plurality of cutting units 3 mounted to the holder 2. For each cutting unit 3, the first peripheral portion 18 of the shaving surface 7 of the external cutter 4 is closer to the other external cutters 4 than the second peripheral portion 19 of the shaving surface 7. Thus, the tilting axis 17 of each cutting unit 3 is located close to the other cutting units 3, which provides more adaptability to variations in angulation of the housing 1 relative to the skin surface 20 as is best seen in FIGS. 7A to 7D.

Figure 7A:
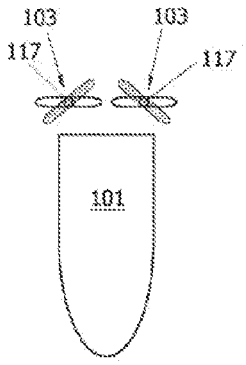
PRIOR ART FIG. 7A
FIG. 7A is a schematic representation of a shaving apparatus according to the prior art with the tiltable cutting units in two alternative positions (filled in and with no fill)
Figure 7B:
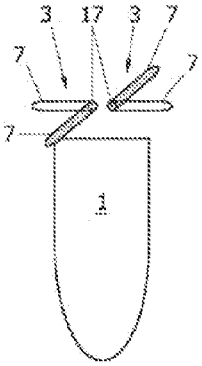
FIG. 7B is a schematic representation of a shaving apparatus according to the present invention with the tiltable cutting units in two alternative positions (filled-in and with no fill)

In FIGS. 7A and 7B, the filled-in representation and the non filled-in representations of the cutting units 3, 103 show the cutting units 3, 103 tilted into different orientations.

Figure 7C:
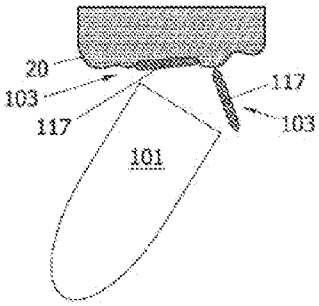
PRIOR ART FIG. 7C
FIG. 7C is a schematic representation of the shaving apparatus according to FIG. 7A held against a skin surface at an angle.
Figure 7D:
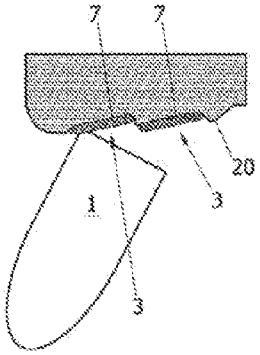
FIG. 7D is a schematic representation of the shaving apparatus according to FIG. 7B held against a skin surface at an angle.

In the prior art shaving apparatuses of the type described above, the cutting units 103 are each tiltable about an axis 117 that extends centrally relative to the shaving surface (see FIGS. 7A and 7C). More specifically, in such shaving apparatuses, the tilting axis 117 intersects a centre line of the shaving surface perpendicular to the shaving surface. In FIG. 7C, which illustrates the situation when holding a shaving apparatus according to the prior art at an angle relative to a skin surface 20 to be shaved, one of the cutting units 103 is capable of accommodating to the angle between the housing 101 and the skin surface 20 to be shaved, whereas the other one of the cutting units 103 is not in contact with the skin. Thus, in such a situation, only a portion of the total shaving surface is actually operative. In the example of an apparatus according to the invention as shown in FIGS. 7B and 7D, each cutting unit 3, or at least its suspension member, is tiltable about a tilting axis 17 closer to a side of that cutting unit 3 facing the other cutting unit or units 3 than to an opposite side of the respective cutting unit 3. Thus, when one of the suspension members and the external cutter carried thereby is pressed towards the housing and caused to tilt towards the housing 1 and the external cutter of the other cutting unit remains in a position maximally (or close to maximally) projecting away from the housing 1, only very little offset between the planes in which the shaving surfaces 7 of the external cutters 4 of the cutting units 3 is caused. This in turn, allows the shaving surfaces 7 of both cutting units 3 to be sufficiently coplanar to remain both in operative contact with the skin surface 20 to be shaved, even when the orientation of the shaving apparatus as a whole is far from perpendicular to the skin surface to be shaved. This is of particular advantage when shaving in the area of the chin and the lower jaw.

In addition, the external cutter may be arranged to be tiltable in any direction relative to the holder suspension, so that the shaving surface a further adaptability to the shape of the facial area to be shaved is obtained.

Figure 5:
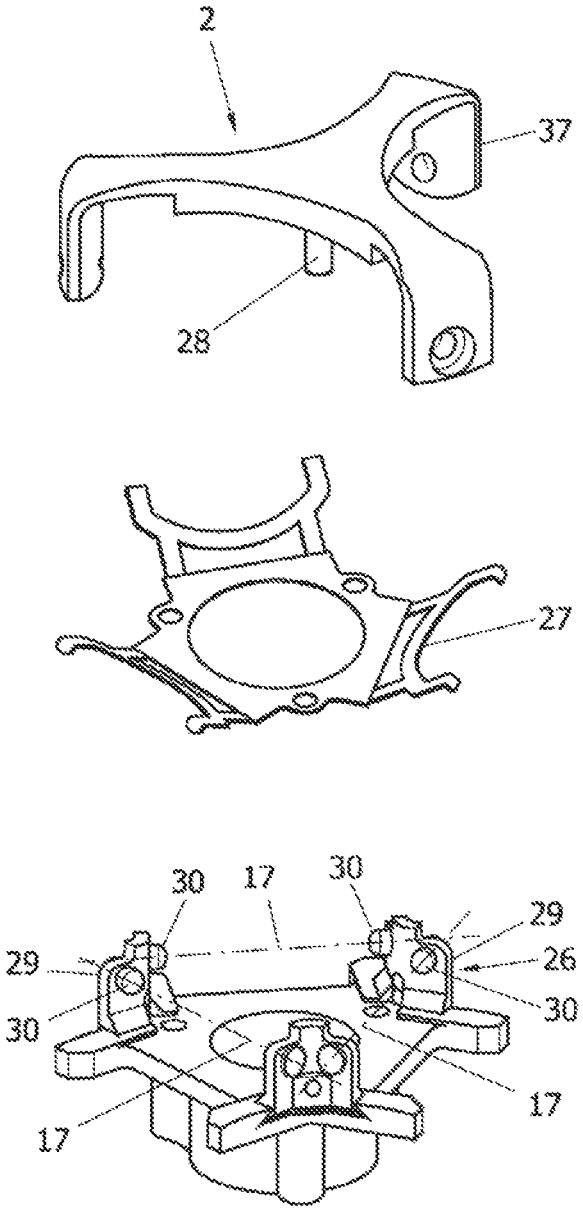
FIG. 5 is a perspective, exploded view of the holder of the shaving apparatus according to FIGS. 1-4.

The tiltability of the suspension members 6 about tilting axes 17 located closely together furthermore allows the portions of the shaving surface 7 that are at the outside of the arrangement of cutting units 3 to tilt over a large range of travel with a relatively simple construction, in particular if the suspension members 6 are supported by a holder 2 in the form of a centrally located post (see FIGS. 3 and 5). This, in turn provides an improved adaptability to variations in curvature of the skin surface 20 to be shaved while maintaining an effective support of the skin by the skin support rim 13 that is part of the tiltable suspension member 6. Accordingly, variations in the contact pressure between, on the one hand, the portions of the shaving surfaces 7 of the cutting units 3 that are remote from each other and, on the other hand, the skin surface 20 are further reduced.

The suspension members 6 are pivotable independently from each other. As is best illustrated by FIGS. 3, 7B and 7D, this is advantageous for obtaining conformability to variations in angulation between the shaving apparatus and the skin surface 20 as well as to differences in the curvature of the skin surface 20 to be shaved.

According to the present example, the pivoting axes 17 are located at identical distances from a centre line 24 at identical distance from centres of the cutting surfaces 7 of the cutting units 3. Thus, a uniformly shaped overall shaving surface is defined by the shaving surfaces 7 when the cutting units 3 are in the rest position shown in FIGS. 1 and 3.

The invention claimed is:

1. A shaving apparatus comprising a housing, provided with a holder to which at least two cutting units are mounted, which cutting units each comprise an external cutter having cutting edges and an outer shaving surface for contacting the skin, interrupted by hair entry apertures, an internal cutter rotatably mounted in the external cutter and having cutting edges, the internal cutter is drivable for movement along the hair entry apertures for cutting off hairs projecting through the hair entry apertures, the cutting edges of the internal cutter are arranged for co-operation with the cutting edges of the external cutter, and a suspension member via which the external cutter is suspended relative to the holder, wherein the suspension member of each cutting unit is individually tiltable relative to the holder about a tilting axis, wherein the tilting axis of each suspension member is located more closely to a first peripheral portion of the shaving surface of the associated cutting unit than to a second peripheral portion of the shaving surface of the associated cutting unit opposite to said first peripheral portion of said shaving surface.

2. A shaving apparatus according to claim 1, wherein the suspension member is spring loaded for biasing the suspension member to a rest position and is tiltable against a force biasing the suspension member to the rest position from the rest position towards the housing to a tilted position.

3. A shaving apparatus according to claim 1, wherein the suspension members are independently tiltable.

4. A shaving apparatus according to claim 1, wherein the shaving surface of said external cutter extends over at least two different shaving zones, a first one of said shaving zones being located closer to said tilting axis than a second one of said shaving zones, said first one of said shaving zones being adapted for shaving allowing the skin to dome less closely to the internal cutter at a given contact pressure than said second one of said shaving zones.

5. A shaving apparatus according to claim 4, wherein the external cutter is thicker in said first zone than in said second zone.

6. A shaving apparatus according to claim 4, further comprising a skin support rim having a free end projecting and extending closely along a rim of said external cutter, and wherein the said skin support rim projects further and/or is located more closely in lateral direction to the external cutter along said first peripheral portion of said shaving surface than along said second peripheral portion of said shaving surface.

7. A shaving apparatus according to claim 1, wherein rotation of the internal cutter about an axis transverse to the shaving surface is drivable relative to the external cutter.

8. A shaving apparatus according to claim 7, wherein the internal cutter has a cutting edge or cutting edges movable along a circular path extending over an inner surface of the external cutter, and wherein, a projection of the tilting axis, in a direction perpendicular to the shaving surface, onto the shaving surface, forms a tangent to said circular track.

9. A shaving apparatus according to claim 1, wherein at least two of said cutting units are mounted to said holder, and wherein, for each external cutter, said first peripheral portion of the shaving surface is closer to the other external cutter or at least one of the other external cutters than said second peripheral portion of the shaving surface.

10. A shaving apparatus according to claim 9, wherein a cap between said cutting units forms a support surface for contacting the skin during shaving, said support surface extending exclusively between at least two of the cutting units.

11. A shaving apparatus according to claim 10, wherein the cap is adjustable for adjusting the position of a plane along which the support surface extends relative to the position of at least one plane along which the shaving surfaces extend.

12. A shaving apparatus according to claim 9, wherein the suspension is spring loaded for biasing the external cutters to rest positions in which the shaving surfaces face in mutually converging directions, the shaving surfaces being tiltable at least to a configuration in which shaving surfaces of the external cutters are in a mutually more parallel orientation.

13. A shaving apparatus according to claim 9, wherein the tilting axes are located at identical distances from a centre line at identical distance from centres of the cutting surfaces of the cutting units.

14. A shaving apparatus according to claim 1, wherein the pivoting axis is tangential to a cutter gear wheel rotatably mounted to the suspension member for rotation in a plane parallel to the shaving surface and to a driving gear wheel engaging the cutter gear wheel for driving the cutter gear wheel and extends through an area where teeth of the drive gear wheel engage teeth of the cutter gear wheel.

15. A shaving apparatus comprising a housing, provided with a holder to which at least two cutting units are mounted, which cutting units each comprise an external cutter having an outer shaving surface for contacting the skin, interrupted by hair entry apertures, an internal cutter which is drivable for movement along the hair entry apertures for cutting off hairs projecting through the hair entry apertures, and a suspension member via which the external cutter is suspended relative to the holder, wherein the suspension member of each cutting unit is individually tiltable relative to the holder about a tilting axis, wherein the tilting axis of each suspension member is located more closely to a first peripheral portion of the shaving surface of the associated cutting unit than to a second peripheral portion of the shaving surface of the associated cutting unit opposite to said first peripheral portion of said shaving surface, wherein the shaving surface of said external cutter extends over at least two different shaving zones, a first one of said shaving zones being located closer to said tilting axis than a second one of said shaving zones, said first one of said shaving zones being adapted for shaving allowing the skin to dome less closely to the internal cutter at a given contact pressure than said second one of said shaving zones, and wherein the external cutter is thicker in said first zone than in said second zone, wherein at least two of said cutting units are mounted to said holder, and wherein, for each external cutter, said first peripheral portion of the shaving surface is closer to the other external cutter or at least one of the other external cutters than said second peripheral portion of the shaving surface.

16. A shaving apparatus according to claim 15, wherein a cap between said cutting units forms a support surface for contacting the skin during shaving, said support surface extending exclusively between at least two of the cutting units.

17. A shaving apparatus according to claim 16, wherein the cap is adjustable for adjusting the position of a plane along which the support surface extends relative to the position of at least one plane along which the shaving surfaces extend.

18. A shaving apparatus according to claim 15, wherein the suspension is spring loaded for biasing the external cutters to rest positions in which the shaving surfaces face in mutually converging directions, the shaving surfaces being tiltable at least to a configuration in which shaving surfaces of the external cutters are in a mutually more parallel orientation.

19. A shaving apparatus according to claim 15, wherein the tilting axes are located at identical distances from a centre line at identical distance from centres of the cutting surfaces of the cutting units.

20. A shaving apparatus according to claim 15, wherein the pivoting axis is tangential to a cutter gear wheel rotatably mounted to the suspension member for rotation in a plane parallel to the shaving surface and to a driving gear wheel engaging the cutter gear wheel for driving the cutter gear wheel and extends through an area where teeth of the drive gear wheel engage teeth of the cutter gear wheel.

* * * * *